United States Patent [19]

Sayklay

[11] Patent Number: 4,483,036

[45] Date of Patent: Nov. 20, 1984

[54] ARTIST'S PAINTING AID

[76] Inventor: Alex R. Sayklay, 529 San Saba, El Paso, Tex. 79912

[21] Appl. No.: 560,750

[22] Filed: Dec. 12, 1983

[51] Int. Cl.[3] ..... A46B 9/02

[52] U.S. Cl. ..... 15/160; 15/192; 15/DIG. 5; 15/210.5

[58] Field of Search ..... 15/160, 159 R, 192, 15/193, 191 R, 106, 210 R, 210 A, 210.5, DIG. 5

[56] References Cited

U.S. PATENT DOCUMENTS 2,511,235 6/1950 Arwood ..... 15/106 X
4,255,827 3/1981 Palazzo ..... 15/DIG. 5

FOREIGN PATENT DOCUMENTS 20683 of 1894 United Kingdom ..... 15/106

*Primary Examiner*—Peter Feldman
*Attorney, Agent, or Firm*—Milton D. Wyrick

[57] ABSTRACT

An artist's brush helpful in painting leafy vegetation such as trees, bushes, and the like, having a plurality of tiered layers of bristles, each of said layers containing bristles of various lengths arranged within said tiered row to form a plurality of furcations. By application of the brush to canvas, the furcations create alternating painted and unpainted areas, creating an effect similar to that of spaced apart leaves.

5 Claims, 6 Drawing Figures

ARTIST'S PAINTING AID

TECHNICAL FIELD

This invention relates to common bristle paint brushes, and more particulary to the paint brushes to be used by beginning and intermediate artists.

BACKGROUND OF THE INVENTION

Various methods have been employed by artists, particularly beginning or intermediate artists, to simply and efficiently paint leafy vegetation such as trees, bushes, and the like. Even more advanced artists often have a need to provide specific pattern effects in a painting. Items such as these are extremely difficult and time consuming to achieve with a typical artist's brush. Because of this, certain painting aids have been developed. One of the most common is the sponge. When a sponge is wetted with paint and carefully applied to the artist's canvas, it can produce spaced apart dabs of paint useful for representing foilage or other special effects. Such use of the sponge requires considerable expertise to produce the desired effect.

Another painting aid for the depiction of leafy vegetation is the "Funny Brush," a registered trademark of Lesnick Art Studio, Inc. This aid comprises a plastic cylinder in which are affixed a quantity of rubber strips, each having cross section dimensions of approximately $1/16'' \times \frac{1}{8}''$. This aid is used by immersing the rubber strips into paint and dabbing the strips onto the canvas. This aid suffers from two drawbacks. One is that the rubber strips do not retain a sufficient quantity of paint, necessitating frequent re-dipping. Also, the manufacturer warns that because of the composition of the rubber strips, the "Funny Brush" cannot be cleaned with normal artist's solvents.

Both the sponge and the "Funny Brush", because they are not comprised of bristles, cannot produce painted patterns having a texture like those painted with a bristle brush.

The disavantages of the prior art are overcome by the present invention, and an improved artist's brush is provided for assisting the artist in depicting leafy vegetation and other specific pattern effects.

SUMMARY OF THE INVENTION

An improved bristled artist's brush is provided for depicting leafy vegetation such as trees, bushes, and the like. The brush is comprised of a plurality of layers of bristles wherein each layer of bristles contains bristles of various lengths arranged so that two or more furcations project above the shorter bristles in the layer. These furcations may be rectangular, triangular, oval, toothed, or any other shape.

When such a brush is dipped into paint and applied to the canvas with its handle held at an acute angle to the canvas, the furcations produce individual dabs of paint spaced apart from one another in a predetermined pattern. Continued application of the brush in a jabbing type motion with one or more of the brush's layers can produce the desired density of the paint dabs within a given area, closely resembling an impressionistic type depiction of leafy vegetation.

The present invention therefore allows the artist, particularly the beginning and intermediate artist, in a matter of seconds, to attractively depict such leafy vegetation as trees, bushes, and the like, which depictions are much more attactive and simply produced than those effected by other painting means.

It is a feature of the present invention to easily and simply produce representations of leafy vegetation and other specific pattern effects in paintings.

It is yet another feature of the present invention to provide an aid to the depiction of leafy vegetation that will provide a texture on the canvas similar to that produced by other bristle brushes used by the artist.

It is a further feature of the present invention to allow beginning and young artists to paint leafy vegetation, in a matter of seconds, which is comparable to that produced by an advanced artist using conventional means.

These and other features and advantages of the present invention will become apparent from the following detailed description, wherein reference is made to the figures in the accompanying drawings.

IN THE DRAWINGS

DETAILED DESCRIPTION

Figure 1:
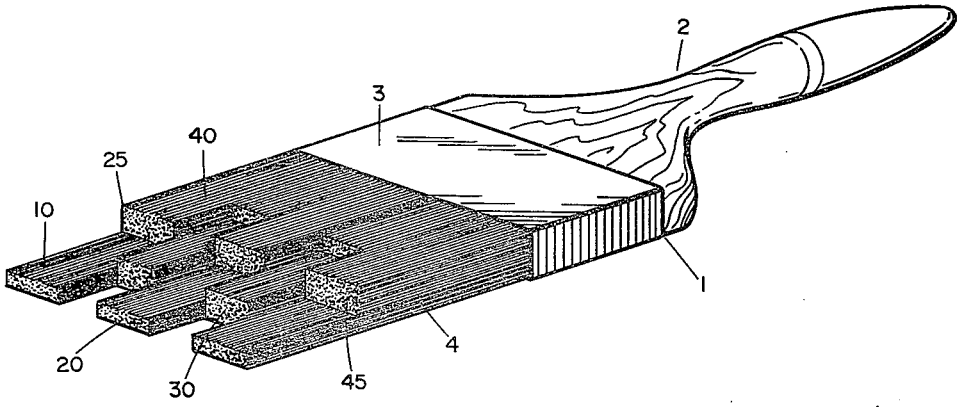
FIG. 1 is a pictorial view of one embodiment of the artist's brush showing a rectangularly shaped bristle brush containing three tiered layers, each layer a plurality of rectangular furcations offset from the furcations in adjacent layers.

Referring now to FIG. 1, one embodiment of the present invention is depicted for use in painting leafy vegetation and the like. The term furcations as used herein is to describe the grouping of bristles formed by projecting the longer bristles of each layer of the brush beyond the shorter bristles of that layer. It should be understood that the furcations can be of any shape, either rectangular as is shown in FIG. 1, or triangular, toothed, oval or any other shape. Different furcation shapes yield slightly different effects on the artist's canvas.

As shown in FIG. 1 the bristle artist's brush 1 is comprised of a handle 2, and a ferrule 3 from which the bristles 4 extend. This particular embodiment contains three furcated bristle layers, 10, 25 and 40, arranged in a tiered fashion. Each of said furcated bristle layers contains bristles of a maximum and minimum length which form the plurality of furcations in each layer. In this manner, bristle layer 10 has its maximum length bristles arranged to form rectangular furcations 20. Bristle layer 25 also comprises bristles having maximum and minimum lengths, the maximum length bristles being equal in length to the minumum length bristle of bristle layer 10. The maximum length bristle of bristle layer 25 are further arranged to form rectangular furcations 30. In a like manner bristle layer 40 also contains bristles having maximum and minimum lengths, the maximum length bristles being equal in length to the minimum length bristles of bristle layer 25. The maximum length bristles bristle layer 40 are further arranged to form furcations 45. As shown, the three furcations 20 of bristle layer 10 are offset from the two furcations 30 of bristle layer 25. In a like manner the two furcations 30 of bristle layer 25 are offset from the three furcations 45 of bristle layer 40.

It has been found that the brush's bristles 4 should be of natural materials (i.e. animal hair). Such natural bristles produce results superior to those produced by bristles comprised of nylon or polyester compositions.

Figure 2:
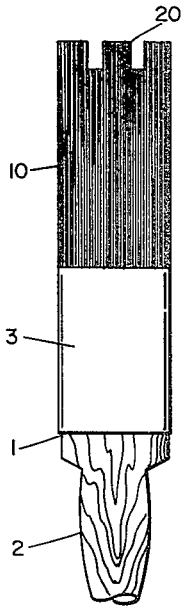
FIG. 2 is a pictorial front view of the layer of bristles of the artist's brush of FIG. 1 having the longest bristle lengths.

FIG. 2 is a frontal sectional view of the brush depicted in FIG. 1 illustrating the arrangement of the bristles in bristle layer 10. As shown, the maximum length bristles are arranged to form three (3) furcations 20.

Figure 3:
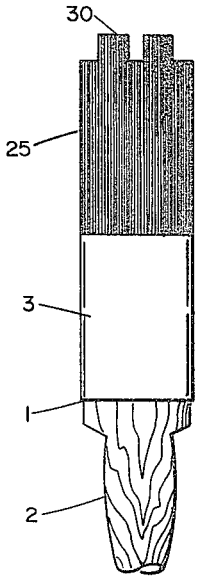
FIG. 3 is a pictorial front view of the middle layer of bristles of the artist's brush of FIG. 1.

FIG. 3 is a frontal sectional view of bristle row 25, the middle layer of bristles shown in FIG. 1. As indicated, the maximum length bristles of bristle layer 25 are arranged to form two furcations 30. Also to be noted is the fact that in this embodiment the length of the maximum length bristles in furcations 30 are equal in length to the minimum length bristles of bristle layer 25

Figure 4:
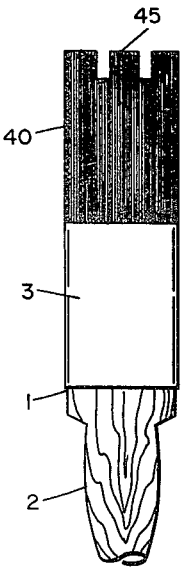
FIG. 4 is a pictorial front view of the layer of bristles of the artist's brush of FIG.1 having the shortest bristle lengths.
Figure 5:
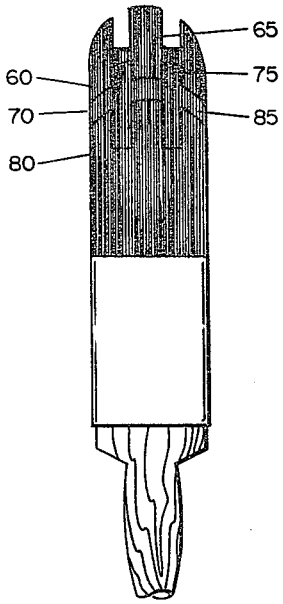
FIG. 5 is a pictorial front view of an artist's brush containing three tiered layers of bristles in which the bristles are arranged to form oval shaped furcations.

FIG. 4 is a frontal sectional view of bristle layer 40. It's maximum length bristles arrange to form three furcations 45, the length of the bristles in furcations 45 being equal in length to the minimum length bristles of bristle layer 25 as illustrated in FIG. 3. Although the embodiment of the brush, as illustrated in FIGS. 1, 2, 3 and 4, illustrates bristle layers having minimum length bristles of a first bristle layer equal in length to the maximum length bristles of the next layer, there is no intention to limit the invention to such an embodiment. Somewhat different but equally interesting depictions can be achieved with bristles of various maximum and minimum lengths. This situation is depicted in FIG. 5 which illustrates an artist's brush also having three tiered layers of bristles 60, 70 and 80. In this illustration the furcations 65, 75 and 85 are rounded and the maximum length bristles of each successive layer are not equal in length to the minimum length bristles of the next preceding bristle layer. A brush configured in this manner has been shown to create easily the more rounded examples of leafy vegetation, such as bushes and the like.

Figure 6:
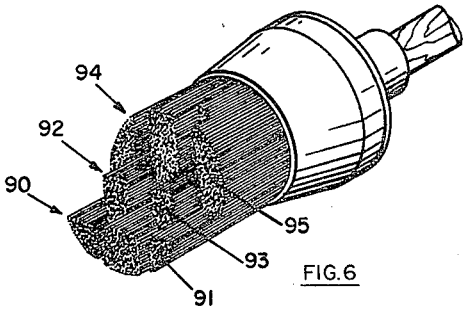
FIG. 6 is a pictorial view of a round shaped bristle brush also configured with three tiered layers, each layer comprising furcations offset from the furcations in adjacent layers.

Referring now to FIG. 6 wherein a brush having its bristles arranged in a round fashion is depicted. This brush also has three (3) layers of bristles 90, 92 and 94 arranged within a ferrule 91. In like manner to the rectangular brush of FIG. 1, this round brush contains the same number of furcations in each respective layer with its furcations offset from the furcations in each adjacent layer of bristles. That is, layer 90 has three (3) furcations 91 which are offset from the two (2) furcations 93 of layer 92. Similarly the furcations 93 of layer 92 are offset from the three (3) furcations 95 of layer 94. It has been found that round brushes such as these are particularly useful in the painting of trees.

Although the illustrated embodiments of the artist's brush has been of brushes with rectangular and round shapes, it should be understood that the invention is not limited to such brushs. Brushes of any other basic shape are equally adaptable for such use as are disclosed by this invention.

It is therefore apparent that the present invention is one well adapted to obtain all the objects and advantages hereinabove set forth together with other advantages which will become obvious and inherent from a description of the apparatus itself. It will be understood that certain combinations and subcombinations are of utility and may be obtained without reference to other features and subcombinations. This is contemplated by and is within the scope of the present invention.

As many possible embodiments may be made of this invention without departing from the spirit or scope thereof, it is to be understood that all matters herein set forth in the accompanying drawings are to be interpreted as illustrative and not in any limiting sense.

What is claimed is:

1. A bristled paint brush for obtaining a predetermined painted pattern comprising:

a plurality of layers of bristles arranged in a tiered fashion, wherein each layer of bristles comprises bristles of varying lengths, forming a plurality of furcations, and wherein said furcations in each layer of bristles are offset from the furcations in adjacent layers of bristles.

2. The paint brush of claim 1 wherein said plurality of layers of bristles comprises three or more layers of bristles.

3. The paint brush of claim 1 wherein said layers of bristles are comprised of natural bristles.

4. A paint brush for obtaining a predetermined painted pattern, comprising:

at least a pair of bristle layers, including:

a first layer with a first maximum and a first minimum bristle length forming a first plurality of furcations, and a second layer with a second maximum and second minimum bristle length forming a second plurality of furcations, wherein said first minimum bristle length is greater than said second maximum bristle length.

5. The paint brush of claim 4 wherein said first minimum bristle length is equal to said second maximum bristle length.

* * * * *